United States Patent [19]

Joos

[11] Patent Number: 4,953,341

[45] Date of Patent: Sep. 4, 1990

[54] SPACERS FOR LAYING TILE AND METHOD OF USE

[76] Inventor: Bob Joos, 760 E. 12000 S., Draper, Utah 84020

[21] Appl. No.: 393,236

[22] Filed: Aug. 14, 1989

[51] Int. Cl.[5] ..... E04G 21/16

[52] U.S. Cl. ..... 52/747; 52/127.2; 52/387; 52/392; 52/DIG. 1; 33/404

[58] Field of Search ..... 52/127.1, 96, 387, 392, 52/603, 482, 562, 687, 712, 127.2, 747, DIG. 1, 749; 33/195, 404

[56] References Cited

U.S. PATENT DOCUMENTS

| | | | |
|---|---|---|---|
| 1,836,964 | 12/1931 | Grigsby et al. . | |
| 2,031,684 | 2/1936 | Berger . | |
| 2,869,356 | 1/1959 | Kulhavy et al. | 52/422 X |
| 2,930,135 | 3/1960 | Rodtz, Sr. . | |
| 3,295,281 | 1/1967 | Dixon | 52/442 |
| 3,411,257 | 11/1968 | Yaremchuk . | |
| 4,223,792 | 11/1980 | Malavasi | 52/387 |
| 4,334,397 | 6/1982 | Hitz . | |
| 4,503,654 | 3/1985 | Cosentino | 52/392 X |
| 4,761,926 | 8/1988 | Rea et al. | 52/387 |
| 4,774,793 | 10/1988 | Mayer | 52/442 X |

FOREIGN PATENT DOCUMENTS

| | | | |
|---|---|---|---|
| 283895 | of 1928 | United Kingdom | 52/603 |
| 1228579 | 10/1967 | United Kingdom . | |

*Primary Examiner*—David A. Scherbel
*Assistant Examiner*—Lan Mai

[57] ABSTRACT

A single piece spacer element is disclosed for insertion between spaces between tiles for uniform spacing of the tiles. The spacer element comprising a plurality of legs extending radially from a common juncture, with the legs being formed with beveled edges which facilitate their removal from the adhesive material between the tiles once the adhesive has cured. The invention also comprises integrally formed cylindrical or U-shaped stems which extend from the surface of the spacer element and which aid in placement and removal thereof. The invention also comprises the method of using the spacer element to space and align tiles.

9 Claims, 2 Drawing Sheets

SPACERS FOR LAYING TILE AND METHOD OF USE

BACKGROUND OF THE INVENTION

1. Field of the Invention

The present invention relates broadly to spacers used in laying tile. In particular, the present invention relates to spacers made of a shape which allows for convenience in their placement between and subsequent removal from rows of tiles.

2. Description of the Prior Art

In laying tile, the usual procedure is to apply a coating of adhesive or cement to the substrate or surface that is to be tiled. The individual tile pieces are then placed edge to edge on the substrate in contact with the adhesive or cement. For appearance as well as good construction, the tiles are laid with relatively narrow joint spaces between mutually adjacent edges thereof. After the adhesive or cement has cured and the tiles are firmly adhered to the substrate, the narrow joint spaces between the tiles are filled with a grout.

Laying of tiles with joint spaces therebetween has its disadvantages due to the difficulties experienced by the mason in maintaining uniformity of the joint spaces as the tiles are being laid. Uniform joint spacing is necessary to maintain desirable alinement of the rows and columns of tiles. It has been customary to place a spacer element between the tiles as they are being laid, with the spacer element being removed after the tiles have been firmly secured to the substrate by curing of the adhesive or cement. Following removal of the spacers, the open joint spaces are then filled with a grout.

Early practice was to place a heavy cord or string between the tiles as they were being laid. After the adhesive or cement had cured and the tiles were firmly adhered to the substrate, the cord or string was removed and the spaces between the tiles were filled with grout. In U.S. Pat. No. 2,031,684 and 2,930,135 there are disclosed small spacer elements made of rubber or other plastics materials which are designed to be placed between the tiles at mutually respective corners and/or edges of adjacent tiles. In the first mentioned patent, the spacers have a thickness which is substantially less than the thickness of the tiles, such that the spacers need not be removed. Instead, the grout is simply filled into the spaces between the tiles and over the spacers. Problems are inherent in such a system. The grout placed over the spacers has a tendency to break loose and fall from the tiled structure. Additionally, because of the thinness of the spacers, they are hard to place correctly. This makes it difficult to maintain uniform spacing between tiles.

The spacers of U.S. Pat. No. 2,930,135 are thicker than those of Patent No. 2,031,135 and are designed to be removed from between the tiles after the adhesive or cement has firmly adhered the tiles to the substrate. However, these spacers also have their drawbacks. Because the spacers often become firmly adhered to the adhesive, it can be a difficult task for the mason to take a probe, such as an awl or screwdriver, and remove the spacers from their positions between the tiles.

In a somewhat less relevant patent (U.S. Pat. No. 1,836,964), it is proposed to first adhere an underlying foundation sheet to the substrate. The foundation sheet having raised portions which provide guides for laying the tiles. A major problem with such a system is the inability of the tile to adhere to the foundation sheet.

Also the grout has an increased tendency to fall from the spaces between the tile due to poor adhesion to the foundation sheet.

SUMMARY OF THE INVENTION

A principal objective of the invention is to provide spacers and a method of their use in facilitating the laying of tile.

Another objective of the present invention is to provide spacers used in facilitating the laying of tile which are shaped to allow for ease of placement and removal.

The above and other objectives of the present invention are achieved by providing a novel, unique method of laying tiles to maintain uniform spacing between rows and columns of the tiles. The method comprises spreading a cement or adhesive material on the substrate to which the tiles are to be applied. Tiles are then placed in columns and rows on the substrate and in contact with the cement or adhesive on the substrate. While laying the tiles, spacer elements are positioned between the corners and/or edges of adjacent tiles to maintain uniform spacing therebetween.

The spacers have a plurality of legs extending radially from a common juncture such that a respective leg of each spacer can be positioned between the mutually respective corners or edges of adjacent tiles. The ends of each leg can advantageously be beveled such that when the spacer is placed between the tiles and pressed into the adhesive or cement, at least a portion of the beveled end of each leg will remain above the level of the adhesive.

After the adhesive has set so as to firmly adhere the laid tiles to the substrate, the spacer elements are quickly and easily removed from between adjacent tiles by sliding an awl or screwdriver between the beveled leg end and the adhesive or cement. The beveled end of the spacer leg significantly increases the mechanical advantage of the tool to pry the spacer away from the adhesive and remove it from between the tiles. Removal of the spacer elements creates substantially open channels between the adjacent tiles, and the open channels are then filled with a grout to complete the installation.

In a particularly preferred embodiment of the invention, the spacer elements also include a stem which is integrally formed on a surface thereof. The stem may be a cylindrical extension directed perpendicularly from the spacer surface, or may be a U-shaped extension with the two legs of the U-shape being integrally formed with the surface to generate an opening bordered by the U-shaped extension and the spacer surface. The stem aids in placement of the spacers in between adjacent tiles by allowing the mason to conveniently grip the extension while placing and adjusting the spacer between tiles. After the spacers are properly placed and the adhesive or cement cures, the mason can also use the U-shaped extension to aid in removal of the spacer. This is done by inserting the tool into the opening formed by the U-shaped extension and the spacer surface and lifting or prying the spacer from the adhesive or cement.

BRIEF DESCRIPTION OF THE DRAWINGS

A preferred embodiment of the present invention representing the best mode presently contemplated of carrying out the invention is illustrated in the accompanying drawings in which.

DETAILED DESCRIPTION OF THE EMBODIMENTS

Figure 1:
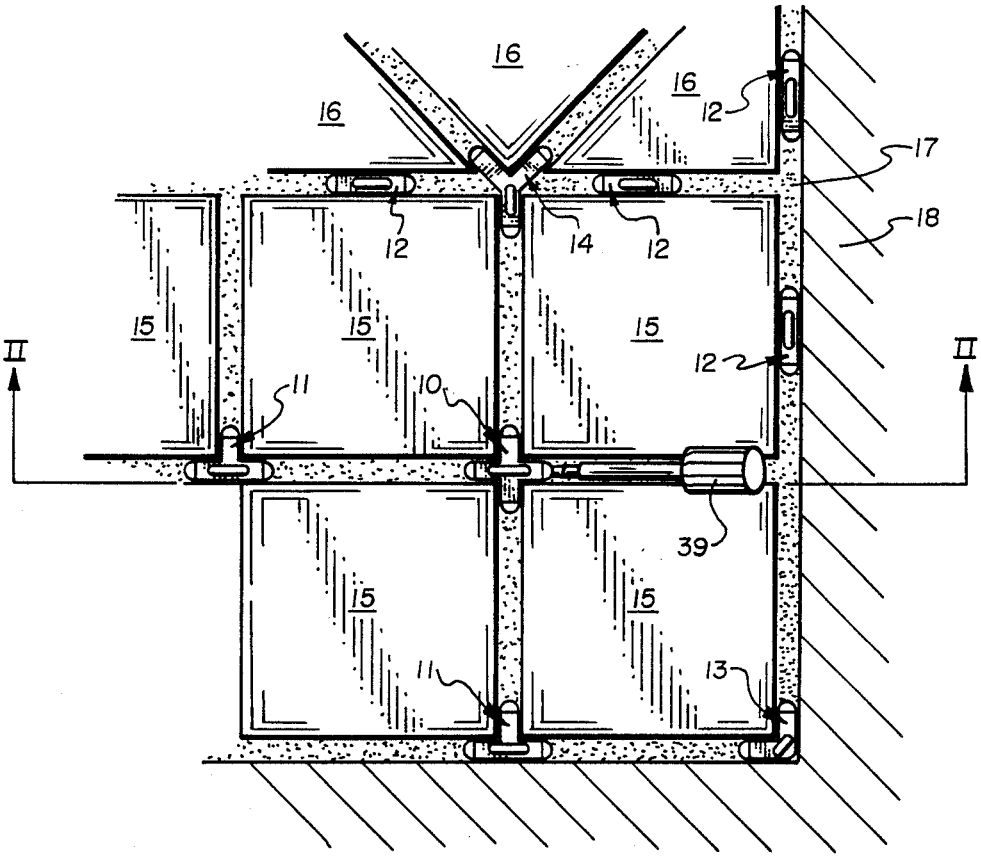
FIG. 1 is a plan view showing a plurality of rectangular tiles maintained in alignment in accordance with the present invention.
Figure 2:
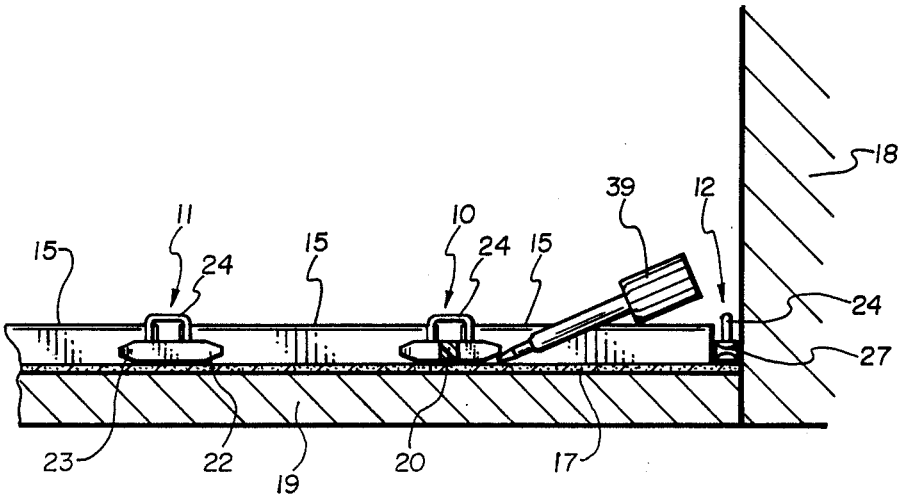
FIG. 2 is cross-sectional view taken along Line II—II of FIG. 1.

Referring to FIGS. 1 and 2, there is shown tiles 15 and 16 which have been laid on a substrate 19 in accordance with the present invention using the spacer elements 10, 11, 12, 13 and 14. FIG. 1 illustrates the spacer elements 10, 11, 12, 13 and 14 as they are used to achieve uniform spacing of the tiles 15 and 16. The tiles 15 are shown smaller in proportion to the spaces therebetween than in actual practice.

The tiles 15 are laid as is well known in the art by first applying an adhesive or cement 17 to the substrate 19 and then positioning the tiles 15 thereon. The tiles 15 are shown being square in shape. However, it should be understood that the tiles can be formed of any desired polygonal shape (such as is shown by tiles 16), and that the spacer elements 10, 11, 12, 13 and 14 are formed in conformity with the shape of the tiles.

The rows and columns of tiles 15 and 16 are accurately aligned in accordance with the present invention to provide substantially uniform spaces there between. This is easily and quickly done, even by relatively inexperienced workers, by placing the spacer elements 10, 11 12, 13 and 14 of the invention between the corners and/or edges of adjacent tiles 15 and 16 as they are laid in place on the adhesive 17. The spacer elements 10, 11, 12 13 and 14 allow the worker to quickly lay the tiles 15 and 16 while maintaining very accurate alignment.

Figure 3:
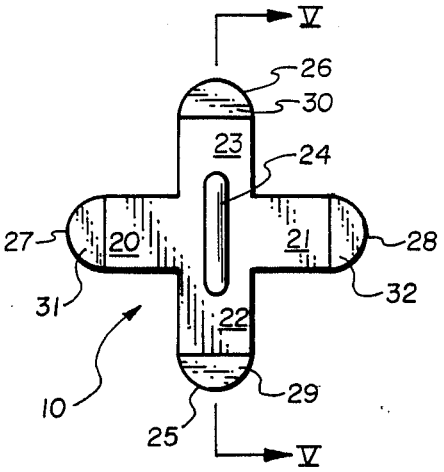
FIG. 3 is a plan view of a spacer element in accordance with the present invention.
Figure 4:
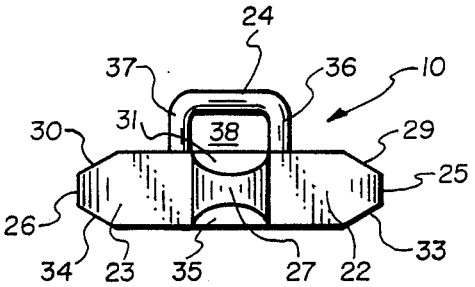
FIG. 4 is a side elevation view of the spacer element of FIG. 3.

The spacer elements 10 are preferably formed of a single, unitary piece of solid, semi-rigid, polymeric material. The spacer elements 10, as best shown in FIGS. 3 and 4, comprise a plurality of legs 21, 22, 23 and 24 extending radially from a common juncture. The width of the legs 21, 22, 23 and 24 is, of course, the width of the desired spaces to be maintained between the tiles 10. The thickness of the spacer elements 10, 11, 12, 13 and 14 can be any desired dimension, but is preferably at least the thickness of the tiles 15 and 16.

As mentioned above, the spacer elements 10, 11, 12, 13 and 14 are preferably formed of a solid, semi-rigid, polymeric material. This is so that the legs 21, 22, 23 and 24 can be deformed to a limited degree. The limited deformability of the legs 21, 22, 23 and 24 allow for accommodation in variation in the dimensions of individual tiles 15 and 16 as well as to allow the worker to compensate for any previous small misalignment that may have occurred in laying antecedent rows of tiles 15 and 16. The spacers 10, 11, 12, 13 and 14 may, however, be made of any rigid or semi-rigid material such as wood or metal.

Figure 6:
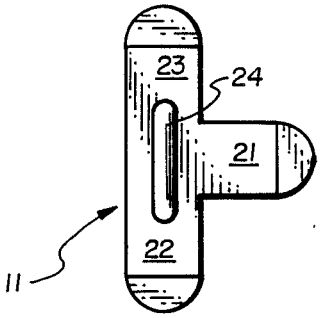
FIGS. 6–9 are plan views of further embodiments of the spacer in accordance with the present invention.
Figure 7:
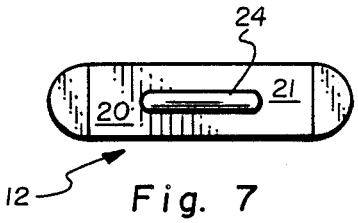
Figure 8:
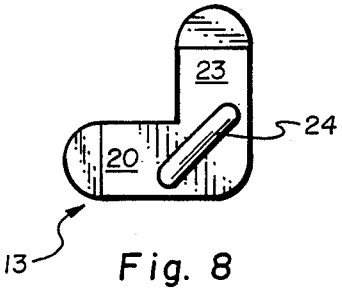
Figure 9:
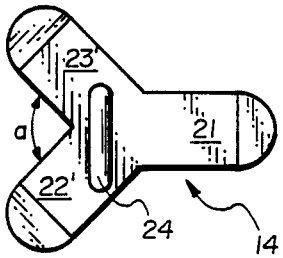

The spacer elements 10 advantageously have four legs which extend in a cross shape as shown in FIG. 3. Such spacer elements 10 can be modified by the worker by cutting selected legs 21, 22, 23 and/or 24 therefrom as is needed in laying the rows of tile as is best illustrated by FIG. 1. Modified spacers 11, 12 and 13 as shown by FIGS. 6–8 respectively, are needed for laying corner tiles, edge tiles, unique or differently shaped tiles, border tiles, etc. of the installation. In laying tiles which have more or less sides than the square tile 15 shown in the drawings, the shape and number of legs of the spacer elements of this invention would have to be adjusted accordingly. For example, spacer 14 has three legs (21, 22' and 23'). Legs 22' and 23' can be formed at any angle "a" from each other to meet the spacing requirements of any irregularly shaped tile 16, or to conform to any predetermined pattern.

Although the worker may cut an existing spacer 10 to the shape of spacers 11, 12 or 13, it is also within the scope of the invention to preform any spacer 10, 11, 12 13 and 14.

The leg elements 21, 22, 23 and 24 are advantageously formed with beveled edges (such as are shown as elements 34, 35 and 36 in FIG. 4) which extend from the bottom surface of each leg to the respective ends 25, 26 and 27. When in use, the spacer 10, 11, 12, 13 or 14 is placed on, or pushed slightly into the adhesive 17. The beveled edges 33, 34 and 35, however, remain at least partially extended from the surface of the adhesive 17. After the adhesive 17 cures, the spacer 10, 11, 12, 13 or 14 can be easily removed by placing a tool 39, such as an awl or screwdriver, in between the adhesive 17 and the beveled edge 33, 34 or 35 and then lifting or prying the spacer from the adhesive 17, and subsequently completely remove it from between the tiles 15. The workers ability to easily insert tool 39 between the adhesive 17 and the spacer 10, 11, 12, 13 or 14, greatly speeds the time it takes to dislodge a large number of spacers. This is because the mechanical advantage of prying the spacer from the leverage point provided by the beveled edge 33, 34 and/or 35 is much greater than would be if the worker was left to push directly against end 25, 26 or 27 as is required in prior art devices.

Figure 5:
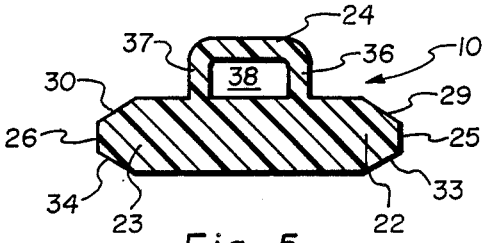
FIG. 5 is a cross-sectional view taken along line V—V of FIG. 3.

A stem 36 may be formed integrally with the top surface of spacers 10, 11, 12, 13 or 14 in order to provide a griping extension for the worker to use when placing and aligning the spacer 10, 11, 12, 13 or 14 between tiles 15 or 16. The stem 36 may be located at any point on the spacer surface and should extend in a direction away therefrom a distance sufficient to allow a worker a good grip thereon. The stem 36 may also advantageously be formed into a U-shape having a second extension 37 and a central portion 24. The U-shaped extension, as best seen in FIGS. 4 and 5, forms an opening 38 with the top surface of the spacer which can also accommodate a tool 39 for aiding in its removal from between tiles after the adhesive 17 has cured. Beveled edges 29, 30, 31 and 32 may also be formed in the ends of legs 20, 21, 22 and 23. These bevels allow for convenience in guiding the tool 39 into the opening 38.

After the tiles 15 have been laid on the substrate and firmly secured thereto by the adhesive or cement 17, the spacer elements 10, 11, 12, and 13 are removed from the spaces between the tiles 15 by applying the tool 39 to the beveled edges 33, 34 or 35, or to the U-shaped extension opening 38. By removing the spacers 10, 11, 12, 13 and 14, there results substantially open channels or spaces between the adjacent tiles 15 and 16. These open spaces are then filled with a grout to form a finished tile surface.

Although a preferred embodiment of the spacer elements 10, 11, 12, 13 and 14, the method of laying tile in accordance with the present invention have been illustrated and described, it is to be understood that the present disclosure is made by way of example and that various other embodiments are possible without departing from the subject matter coming within the scope of the following claims, which subject matter is regarded as the invention.

I claim:

1. A method of laying tiles to maintain uniform spacing between rows and columns of the tiles, said method comprising spreading an adhesive material on a substrate to which said tiles are to be applied;

placing said tiles in columns and rows on the substrate and in contact with said adhesive;

placing spacer elements into said adhesive material between the edges of adjacent tiles as the tiles are laid, said spacer elements consisting of a plurality of legs extending radially from a common juncture, each of said legs having a top surface, bottom surface, and an end surface, each of said bottom surfaces lying entirely in a single plane, at least one of said legs of each spacer element having a beveled edge which extends partially above the level of the adhesive material when the spacer is positioned between the edges of adjacent tiles in contact with the adhesive;

allowing the adhesive to set and firmly adhere the laid tiles and the spacer elements to the substrate;

applying a tool to the beveled edge of said at least one leg of the spacer elements to lift the spacer away from said adhesive and said tiles to form substantially open channels between the adjacent tiles; and filling the channels between the tiles with a grout.

2. A method of laying tiles in accordance with claim 1, wherein the legs of one ore more respective spacer elements are occasionally deformed slightly as they are placed between adjacent tiles to accommodate inadvertent misalignment which may otherwise occur in the uniformly spaced rows and columns of tiles.

3. A method of laying tiles in accordance with claim 1, wherein said spacer elements are formed with a stem extending from the surface thereof and the step of placing includes holding the spacer elements by the stem when placing them between adjacent tiles.

4. A method of laying tiles in accordance with claim 3, further including the step of removing at least one of said legs from at least one of said spacer elements wherein before it is placed between adjacent tiles.

5. A single piece spacer element for insertion into spaces between tiles for uniform spacing of the tiles, said spacer element consisting of a plurality of legs extending radially from a common juncture, each of said legs having a top surface, bottom surface, and an end surface, each of said bottom surfaces lying entirely in a single plane, at least one of said legs of said spacer element including a beveled surface extending from its bottom surface in the direction of its top surface to its end surface, and at least one of said legs including a stem extending from said top surface thereof whereby, said spacer having been placed between a plurality of tiles in order to correctly position the tiles can thereafter be removed by applying a tool to said beveled surface to remove said spacer from its location between the tiles.

6. A spacer element in accordance with claim 5, wherein said plurality of legs consists of four legs extending in a cross shape.

7. A spacer element in accordance with claim 5, wherein said spacer is made of a polymeric material which can be deformed to a limited degree to accommodate misalignment of tiles.

placing said tiles in columns and rows on the substrate and in contact with said adhesive;

placing spacer elements into said adhesive material between the edges of adjacent tiles as the tiles are laid, said spacer elements consisting of a plurality of legs extending radially from a common juncture, each of said legs having a top surface, bottom surface, and an end surface, each of said bottom surfaces lying entirely in a single plane, at least one of said legs of each spacer element having a beveled edge which extends partially above the level of the adhesive material when the spacer is positioned between the edges of adjacent tiles in contact with the adhesive;

allowing the adhesive to set and firmly adhere the laid tiles and the spacer elements to the substrate;

applying a tool to the beveled edge of said at least one leg of the spacer elements to lift the spacer away from said adhesive and said tiles to form substantially open channels between the adjacent tiles; and filling the channels between the tiles with a grout.

8. A spacer element in accordance with claim 5, wherein the end surface of each of said legs is arcuate in shape.

9. A spacer element in accordance with claim 5, wherein said stem forms an opening therethrough, whereby said spacer having been placed between a plurality of tiles to ensure proper positioning thereof, can then be removed from its position between the tiles by applying a tool to said opening formed in said stem.

* * * * *